US010598167B2

(12) United States Patent
Ishii et al.

(10) Patent No.: US 10,598,167 B2
(45) Date of Patent: Mar. 24, 2020

(54) SEMISPHERICAL SHOE FOR SWASH PLATE COMPRESSOR AND SWASH PLATE COMPRESSOR

(71) Applicant: NTN CORPORATION, Osaka (JP)

(72) Inventors: Takuya Ishii, Mie (JP); Satoru Fukuzawa, Mie (JP); Hirohisa Abe, Mie (JP); Akihiro Oomori, Mie (JP)

(73) Assignee: NTN CORPORATION, Osaka (JP)

( * ) Notice: Subject to any disclaimer, the term of this patent is extended or adjusted under 35 U.S.C. 154(b) by 153 days.

(21) Appl. No.: 15/328,204

(22) PCT Filed: Jul. 22, 2015

(86) PCT No.: PCT/JP2015/070768
§ 371 (c)(1),
(2) Date: Jan. 23, 2017

(87) PCT Pub. No.: WO2016/013558
PCT Pub. Date: Jan. 28, 2016

(65) Prior Publication Data

US 2017/0211560 A1 Jul. 27, 2017

(30) Foreign Application Priority Data

Jul. 23, 2014 (JP) ..... 2014-150125
Jul. 23, 2014 (JP) ..... 2014-150137
Jul. 23, 2014 (JP) ..... 2014-150150

(51) Int. Cl.
*F04B 27/08* (2006.01)
*F04B 1/20* (2006.01)
(Continued)

(52) U.S. Cl.
CPC ..... *F04B 27/0886* (2013.01); *F01B 3/0088* (2013.01); *F04B 1/148* (2013.01);
(Continued)

(58) Field of Classification Search
CPC ..... F04B 27/1072; F04B 27/0886; F04B 27/0882; F04B 1/146; F04B 1/148;
(Continued)

(56) References Cited

U.S. PATENT DOCUMENTS

2002/0159893 A1 10/2002 Sugiura
2003/0024380 A1 2/2003 Shimo
(Continued)

FOREIGN PATENT DOCUMENTS

CN 1338027 A 2/2002
CN 1364222 A 8/2002
(Continued)

OTHER PUBLICATIONS

English translation of WO2005028864 generated from WIPO website May 2019.*
(Continued)

*Primary Examiner* — Bryan M Lettman
(74) *Attorney, Agent, or Firm* — Hedman & Costigan, P.C.; James V. Costigan; Kathleen A. Costigan

(57) ABSTRACT

A swash plate compressor in which a lubricating film is not formed on a sliding contact surface of the swash plate and the piston owing to the use of the semispherical shoe. The semispherical shoe (4) is subjected to sliding contact with the swash plate of the swash plate compressor and the piston thereof. A base material (5) consists of a metallic member having a resin layer (6*b*) formed on a surface of a planar part (4*b*) that is subjected to sliding contact with the swash plate. A resin layer (6*a*) is formed on a surface of a spherical part (4*a*) to be subjected to sliding contact with the piston. The resin layer (6*a*) and the resin layer (6*b*) are integral with each other. At least one portion of the base material (5) is exposed.

14 Claims, 6 Drawing Sheets

(51) Int. Cl.

| | |
|---|---|
| ***F04B 1/14*** | (2006.01) |
| ***F01B 3/00*** | (2006.01) |
| ***F04B 27/10*** | (2006.01) |
| ***F04B 1/2092*** | (2020.01) |
| ***F04B 1/2085*** | (2020.01) |
| ***F04B 1/148*** | (2020.01) |

(52) U.S. Cl.
CPC ..... *F04B 1/2085* (2013.01); *F04B 1/2092* (2013.01); *F04B 27/0882* (2013.01); *F04B 27/1072* (2013.01)

(58) Field of Classification Search
CPC .... F04B 1/2085; F04B 1/2078; F04B 1/2092; F01B 3/0088
See application file for complete search history.

(56) References Cited

U.S. PATENT DOCUMENTS

| | | | | |
|---|---|---|---|---|
| 2004/0055456 | A1* | 3/2004 | Kurita ..... | F04B 27/1072 92/12.2 |
| 2010/0316517 | A1 | 12/2010 | Tanigawa | |

FOREIGN PATENT DOCUMENTS

| | | | | |
|---|---|---|---|---|
| CN | 1401898 | A | 3/2003 | |
| CN | 2019-63517 | U | 9/2011 | |
| EP | 1148237 | A1 | 10/2001 | |
| EP | 1251274 | A2 | 10/2002 | |
| EP | 1281863 | A2 | 2/2003 | |
| JP | S57-42180 | U | 3/1982 | |
| JP | 61-201782 | A | 9/1986 | |
| JP | H01-224481 | A | 9/1989 | |
| JP | 2002-039062 | A | 2/2002 | |
| JP | 2002-180964 | A | 6/2002 | |
| JP | 2002-317757 | A | 10/2002 | |
| JP | 2003-049766 | A | 2/2003 | |
| JP | 2005-090385 | A | 4/2005 | |
| JP | 2008-138545 | A | 6/2008 | |
| JP | 2008-180138 | A | 8/2008 | |
| JP | 2008-215176 | A | 9/2008 | |
| JP | 2009-257230 | A | 11/2009 | |
| JP | 2013-204463 | A | 10/2013 | |
| JP | 2013-204574 | A | 10/2013 | |
| WO | 2005/028864 | A1 | 3/2005 | |
| WO | WO-2005028864 | A1 * | 3/2005 | ..... F04B 27/0886 |
| WO | 2013/022094 | A1 | 2/2013 | |

OTHER PUBLICATIONS

Supplementary European Search Report dated Jan. 4, 2018.
English Abstract for JP 2008-215176 A dated Sep. 18, 2008.
English Abstract for JP 2008-138545 A dated Jun. 19, 2008.
English Abstract for JP H01-224481 A dated Sep. 7, 1989.
English Claims for J S57-42180 U dated Mar. 8, 1982.
English Abstract for JP 2013-204574 A dated Oct. 7, 2013.
English Abstract for CN 1338027 A dated Feb. 27, 2002.
English Abstract for CN 1364222 A dated Aug. 14, 2002.
English Abstract for CN 2019-63517 U dated Sep. 7, 2011.
International Search Report for PCT/JP2015/070768 dated Oct. 13, 2015.
English Abstract for CN 1401898 A dated Mar. 12, 2003.

* cited by examiner

SEMISPHERICAL SHOE FOR SWASH PLATE COMPRESSOR AND SWASH PLATE COMPRESSOR

TECHNICAL FIELD

The present invention relates to a swash plate compressor for use in an air conditioner and the like and an approximately semispherical shoe, interposed between a swash plate and a piston, for converting a rotational motion of the swash plate into a reciprocating motion of the piston.

BACKGROUND ART

The swash plate compressor is so constructed that inside a housing where a refrigerant is present, a rotational motion of a swash plate mounted perpendicularly and obliquely on a rotational shaft by directly fixing the swash plate thereto or indirectly fixing the swash plate thereto through a coupling member to the rotational shaft is converted into a reciprocating motion of a piston through a semispherical shoe to be subjected to sliding contact with the swash plate to compress and expand the refrigerant. The swash plate compressor is classified into a double swash plate type of compressing and expanding the refrigerant at both sides of the swash plate by using a double head type piston and a single swash plate type of compressing and expanding the refrigerant at one side thereof by using a single head type piston. The semispherical shoe includes a type which slides on only one side surface of the swash plate and a type which slides on both side surfaces thereof. In these swash plate compressors, sliding having a high relative speed of not less 20 m is generated per second on a sliding contact surface of the swash plate and that of the semispherical shoe. Thus the semispherical shoe is used in a very harsh environment.

In lubrication, lubricating oil circulates inside the housing, with the lubricating oil being blended into the refrigerant and diluted and is supplied to sliding contact portions in the form of mist. When an operation is resumed in an operation-suspended state, the lubricating oil is washed away by the vaporized refrigerant. As a result, when the operation is resumed, the sliding contact surface of the swash plate and that of the semispherical shoe have a dry lubricated state in which the lubricating oil is not supplied thereto. As a result, seizure is liable to occur.

As means for preventing the occurrence of the seizure, there is proposed the resin film consisting of polyether ether ketone (PEEK) directly formed on at least the sliding contact surface of the swash plate and that of the semispherical shoe by using an electrostatic powder coating method (see patent document 1). There is proposed the thermoplastic polyimide film containing the solid lubricant formed on the sliding contact surface by using the electrostatic powder coating method (see patent document 2).

To secure a high sliding property in a high speed and high temperature condition, there is proposed the semispherical shoe for the swash plate having the sliding contact layer composed of the binder consisting of the PEEK resin and the solid lubricant dispersed in the binder is formed on the sliding contact portion of at least one of the swash plate, the semispherical shoe, and the piston (see patent document 3).

PRIOR ART DOCUMENTS

Patent Documents

Patent document 1: Japanese Patent Application Laid-Open Publication No. 2002-180964

Patent document 2: Japanese Patent Application Laid-Open Publication No. 2003-049766

Patent document 3: Japanese Patent Application Laid-Open Publication No. 2002-039062

SUMMARY OF THE INVENTION

Problem to be Solved by the Invention

In the conventional arts, to improve the lubrication property of the swash plate and that of the semispherical shoe, methods of forming the sliding contact surface of the swash plate and that of the semispherical shoe of the lubricating film were proposed. Although the lubricating film was formed on the swash plate, the lubricating film has never been formed on the semispherical shoe in the conventional arts. As the reason for this, the sliding area of the semispherical shoe is smaller than that of the swash plate and in addition, the semispherical shoe is subjected to sliding contact with the spherical seat of the piston. Thus it is presumed that the durability of the lubricating film formed on the semispherical shoe cannot be sufficiently obtained owing to generated frictional heat.

According to the conventional arts, the entire surface of the semispherical shoe is covered with the resin film to allow the semispherical shoe to be subjected to the sliding contact with the swash plate and the piston. Thereby the semispherical shoe has low performance in dissipating the generated frictional heat, and thus the temperature of the base material of the semispherical shoe rises. As a result, it may occur that the resin film melts. In addition, the formation of the resin film on the sliding contact surface by using the electrostatic powder coating method or by the application of a coating liquid causes the semispherical shoe to be subjected to a firing temperature. Thus there is a concern that the strength of the semispherical shoe deteriorates. Further in a case where the resin film is formed on each of a plurality of sliding contact surfaces, there is a fear that the resin films are liable to peel off respective sliding contact surfaces. The sliding contact state of the swash plate side of the semispherical shoe and that of the piston side thereof are different from each other. Thus in a case where the entire surface of the semispherical shoe is covered with a uniform resin film, there is a fear that one sliding contact surface becomes short of its sliding contact property and load resistance.

There is a problem that strict processing accuracy is demanded for flatness, parallelism, and thickness of the sliding contact surface of the swash plate having the lubricating film formed on the sliding contact surface thereof and that the swash plate cannot be produced at a low cost because the area of the lubricating film composed of an expensive material is large.

The present invention has been made to deal with the above-described problems. Therefore it is an object of the present invention to provide a semispherical shoe which can be prevented from being subjected to seizure even in a dry lubrication state in which there is no lubricating oil at the start time of an operation of a swash plate compressor, is excellent in its sliding contact property and load resistance, does not deteriorate in its lubricating property due to generated frictional heat, does not subject a resin layer to peeling from a base material, and ensures sufficient durability. It is another object of the present invention to provide a swash plate compressor in which a lubricating film is not formed on a sliding contact surface of the swash plate and that of a piston owing to the use of the semispherical shoe.

Means for Solving the Problem

The semispherical shoe of the present invention for the swash plate compressor is so constructed that inside a housing where a refrigerant is present, a rotational motion of a swash plate mounted perpendicularly and obliquely on a rotational shaft by directly fixing the swash plate thereto or indirectly fixing the swash plate thereto through a coupling member to the rotational shaft is converted into a reciprocating motion of a piston through a semispherical shoe to be subjected to sliding contact with the swash plate to compress and expand the refrigerant. The semispherical shoe is composed of a base material consisting of a metallic member, and a resin layer is formed on a surface of a planar part to be subjected to sliding contact with the swash plate and on a surface of a spherical part to be subjected to sliding contact with the piston. The resin layer of the planar part and the resin layer of the spherical part are integral with each other, and at least one portion of the base material is not covered with the resin layer and is exposed.

(1) A hollow part forming a concave portion in a direction from a spherical part side of the semispherical shoe or a planar part side thereof is formed at a central axis portion of the base material or (2) a hollow part penetrating through the spherical part side and the planar part side is formed at the central axis portion of the base material. At least one portion of the hollow part is not filled with the resin layer and exposed. An axial length of an exposed portion of the hollow part is not less than ⅓ of a height of the semispherical shoe.

The semispherical shoe has a non-contact portion which does not contact the piston is formed on an outer surface of the spherical part side. The base material is not covered with the resin layer and is exposed at the non-contact portion.

At least one portion of a peripheral part connecting the planar part and the spherical part to each other is not covered with the resin layer. The base material is exposed at the above-described one portion of the peripheral part not covered with the resin layer.

A thickness of the resin layer of the planar part and that of the resin layer of the spherical part are 0.1 to 0.7 mm. The resin layer of the planar part and the resin layer of the spherical part are formed integrally with each other on a surface of the base material by injection-molding a resin composition containing aromatic polyether ketone resin as a base resin thereof.

The resin composition contains 1 to 30% by volume of polytetrafluoroethylene resin and 5 to 30% by volume of at least one of carbon fiber and graphite for 100% by volume of the resin composition.

A melt viscosity of the resin composition is 50 to 200 Pa·s when a temperature of the resin composition is 380 degrees C. and a shear velocity thereof is 1000 $s^{-1}$.

The metallic member consists of an iron-based sintered metal, and a density of the metallic member is 0.7 to 0.9 which is a theoretical density ratio of a material used as the base material.

The resin layer of the spherical part is thicker than the resin layer of the planar part.

A thickness of the resin layer of the planar part is not less than 0.1 mm nor more than 0.3 mm. A thickness of the resin layer of the spherical part exceeds 0.3 mm and is not more than 0.7 mm.

The resin layer of the planar part and the resin layer of the spherical part are formed on a surface of the base material by injection molding.

The swash plate compressor of the present invention is so constructed that inside a housing where a refrigerant is present, a rotational motion of a swash plate mounted perpendicularly and obliquely on a rotational shaft by directly fixing the swash plate thereto or indirectly fixing the swash plate thereto through a coupling member to the rotational shaft is converted into a reciprocating motion of a piston through a semispherical shoe to be subjected to sliding contact with the swash plate to compress and expand the refrigerant. The above-described semispherical shoe is the semispherical shoe of the present invention.

A sliding contact surface of the swash plate to be subjected to sliding contact with the semispherical shoe is a polished surface of a base material of the swash plate and does not have a lubricating film thereon.

The above-described refrigerant is carbon dioxide.

Effect of the Invention

The semispherical shoe of the present invention for the swash plate compressor is composed of the base material consisting of the metallic member. The resin layer is formed on the surface of the planar part to be subjected to the sliding contact with the swash plate and on the surface of the spherical part to be subjected to the sliding contact with the piston. One portion of the base material is not covered with the resin layer and is exposed. Thus the semispherical shoe is excellent in its heat dissipation property and load resistance and sliding contact property with the swash plate and the piston. Because the resin layer of the planar part and that of the spherical part are integral with each other, the resin layer can be prevented from peeling off the base material.

(1) The hollow part forming the concave portion in the direction from the spherical part side of the semispherical shoe or the planar part side thereof is formed at the central axis portion of the base material or (2) the hollow part penetrating through the spherical part side and the planar part side is formed at the central axis portion of the base material. At least one portion of the hollow part is not filled with the resin layer and is exposed. Therefore frictional heat is dissipated outside from the exposed portion of the hollow part through the base material, which allows the semispherical shoe to be excellent in its wear resistance and seizure resistance. The axial length of the exposed portion of the hollow part is not less than ⅓ of the height of the semispherical shoe. Therefore it is possible to improve the heat dissipation property of the hollow part. The construction in which the hollow part serves as the heat dissipation part allows the area of the hollow part to be larger than a heat dissipation part formed at a part of the outer surface of the base material.

The semispherical shoe has the non-contact portion which does not contact the piston at the center of the spherical part side thereof. At the non-contact portion, the base material is not covered with the resin layer and is exposed. Therefore frictional heat generated at the spherical part can be easily dissipated from the exposed portion.

At least one portion of the peripheral part connecting the planar part and the spherical part to each other is not covered with the resin layer. The base material is exposed at the above-described one portion of the peripheral part not covered with the resin layer. Therefore the frictional heat is dissipated outside from the exposed portion of the peripheral part through the base material. Therefore the semispherical shoe is allowed to be excellent in its wear resistance and seizure resistance. Because the peripheral part is not subjected to sliding contact with the mating members, the formation of the resin layer on the peripheral part is not essential. Therefore it is possible to allow the area of the heat dissipation part to be larger at the peripheral part than at the spherical part and the planar part.

The thickness of the resin layer of the planar part and that of the resin layer of the spherical part are 0.1 to 0.7 mm. The resin layer of the planar part and that of the spherical part are formed integrally with each other on the surface of the base material by injection-molding the resin composition containing the aromatic PEK resin as its base resin. Therefore the resin layers are excellent in their load resistance and sliding contact property with both the swash plate and the piston. Further because the base resin of the resin composition which forms the resin layers is the aromatic PEK resin, the resin layers are excellent in their frictional wear resistance, seizure resistance, various chemical resistances, and oil resistance. In addition, because pressure is applied to the resin composition when it is in a molten state in an injection-molding operation, the resin layers are formed densely and thus excellent in their load resistance and the like.

Because the thickness of each of the above-described resin layers is as thin as 0.1 to 0.7 mm, it is easy for the frictional heat easily to escape from the friction surface to the base material and thus thermal storage hardly occurs. In addition, because the resin layer of the planar part and that of the spherical part are formed integrally with each other by the injection molding, the resin layers can be prevented from peeling off the base material.

The resin composition contains 1 to 30% by volume of the PTFE resin and 5 to 30% by volume of at least one of the carbon fiber and the graphite for 100% by volume of the resin composition. Therefore even in a high PV condition, it is possible to prevent the resin layer from deforming and wearing, reduce the extent of damage to the swash plate and the piston which are the mating members of the semispherical shoe, allow the resin layer to have a high resistance to oil, and thus prevent the resin layer from being subjected to seizure even in a dry state where there is no oil during the operation of the swash plate compressor.

By setting the melt viscosity of the resin composition to 50 to 200 Pa·s when the temperature of the resin composition is 380 degrees C. and the shear velocity thereof is 1000 $s^{-1}$, the resin composition can be thinly insert-molded.

Because the above-described metallic member consists of the iron-based sintered metal, it is possible to allow the area of the surface of the base material on which the resin layer is to be formed to be large and a high anchor effect to be obtained owing to the irregular configuration of the surface of the base material. Thus it is possible to enhance the adhesiveness between the resin layer and the base material. In forming the resin layer by the injection-molding (insert-molding), the resin layer cuts deeply into the concave and convex portions of the surface of the base material and thus the true joint area between the resin layer and the base material increases. Therefore the adhesiveness between the resin layer and the base material improves. Further because there is an increase in the true joint area between the resin layer and the base material and there is no gap therebetween, the heat of the resin layer is easily transmitted to the base material.

By setting the density of the sintered metal to 0.7 to 0.9 which is the theoretical density ratio of the material used as the sintered metal, it is possible to allow the surface of the base material to be irregular so that the base material and the resin layer firmly adhere to each other and allow the base material to have a required degree of denseness. Therefore it is possible for the base material to securely obtain a sufficient degree of thermal conductivity. In addition, because it is possible to obtain a required joint strength at the joint portion between the resin layer and the base material, it is possible to prevent the resin layer from peeling off the base material even in a case where the semispherical shoe is used in a high PV condition.

The resin layer of the spherical part is thicker than the resin layer of the planar part. The thickness of the resin layer of the planar part subjected to the sliding contact with the swash plate is set thin, whereas the resin layer of the spherical part which has a high load resistance at a high PV and is subjected to the sliding contact with the piston is set thick. Thereby the resin layer of the spherical part has a high comformability with the surface of the piston and is thus excellent in its wear resistance. By forming the resin layer of the planar part and that of the spherical part integrally with each other and differentiating thicknesses of both resin layers from each other, the entire resin layer is allowed to secure a high degree of melt fluidity in an injection-molding operation, and moldability is secured at the thin resin layer of the planar part.

The thickness of the resin layer of the planar part is set to not less than 0.1 mm nor more than 0.3 mm. The thickness of the resin layer of the spherical part is set to be more than 0.3 mm and not more than 0.7 mm. Because the entire resin layer is thin, the frictional heat easily escapes from the friction surface to the base material and thus thermal storage hardly occurs. By setting the thickness of each resin layer to the above-described range, the planar part is allowed to have improved load resistance, and the spherical part is allowed to have improved comformability with the surface of the piston and a high degree of melt fluidity in the injection-molding operation.

The swash plate compressor of the present invention has the above-described semispherical shoe. Therefore the sliding contact surface of the semispherical shoe can be prevented from being subjected to seizure even in a dry lubrication state where there is no lubricating oil at the start time of the operation of the swash plate compressor, is excellent in its sliding contact property and load resistance, and does not deteriorate in its lubricating property due to the generation of the frictional heat. Further the resin layer formed on the base material of the semispherical shoe is prevented from peeling off the base material and is allowed to have a sufficient degree of durability. Therefore the swash plate compressor of the present invention is safe and has a long life. The sliding contact surface of the swash plate to be subjected to the sliding contact with the surface of the semispherical shoe is the polished surface of the base material of the swash plate and does not have a lubricating film. Thus the present invention is capable of providing the swash plate compressor having the function equivalent to that of conventional ones at a lower price than the conventional ones. In addition, because the semispherical shoe can be used at a high surface pressure (for example, more than 8 MPa), the semi spherical shoe can be preferably utilized for swash plate compressors in which carbon dioxide or HFC1234yf is used as a refrigerant.

MODE FOR CARRYING OUT THE INVENTION

Figure 1:
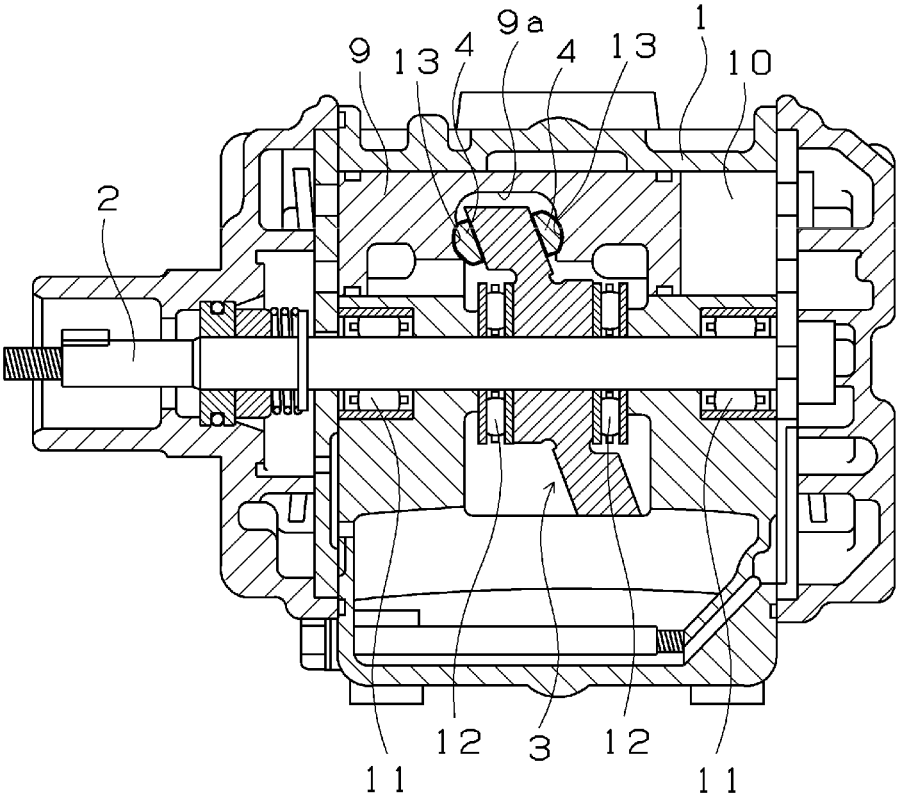
FIG. 1 is a vertical sectional view showing one example of the swash plate compressor of the present invention.

One embodiment of the swash plate compressor of the present invention is described below with reference to the drawings. FIG. 1 is a vertical sectional view showing one example of the swash plate compressor of the present invention. In the swash plate compressor shown in FIG. 1, carbon dioxide is used as a refrigerant. The swash plate compressor shown in FIG. 1 is a double swash plate type so constructed that inside a housing 1 where the refrigerant is present, a rotational motion of a swash plate 3 mounted obliquely on a rotational shaft 2 by directly fixing the swash plate 3 thereto is converted into a reciprocating motion of double-headed type pistons 9 through a semispherical shoe 4 to be subjected to sliding contact with both side surfaces of the swash plate 3 to compress and expand the refrigerant at both sides of each of the double-headed type pistons 9 disposed inside cylinder bores 10 formed at regular intervals in the circumferential direction of the housing 1. The rotational shaft 2 to be driven at a highspeed is supported by a needle roller bearing 11 in its radial direction and by a thrust needle roller bearing 12 in its thrust direction. The swash plate 3 may be indirectly fixed to the rotational shaft 2 via a coupling member. The swash plate may also be mounted on the rotational shaft not obliquely but perpendicularly thereto.

A concave portion 9*a* is formed on each piston 9 in such a way that the concave portion strides over an outer peripheral portion of the swash plate 3. The semispherical shoe 4 is seated on a spherical seat 13 formed on a surface axially opposed to the concave portion 9*a* and supports the pistons 9 movably relative to the rotation of the swash plate 3. Thereby the rotational motion of the swash plate 3 can be smoothly converted into the reciprocating motions of the pistons 9. A spherical part of the semispherical shoe 4 is subjected to sliding contact with the pistons 9 (spherical seat 13), while a planar part of the semispherical shoe is subjected to sliding contact with the swash plate 3.

Figure 2:
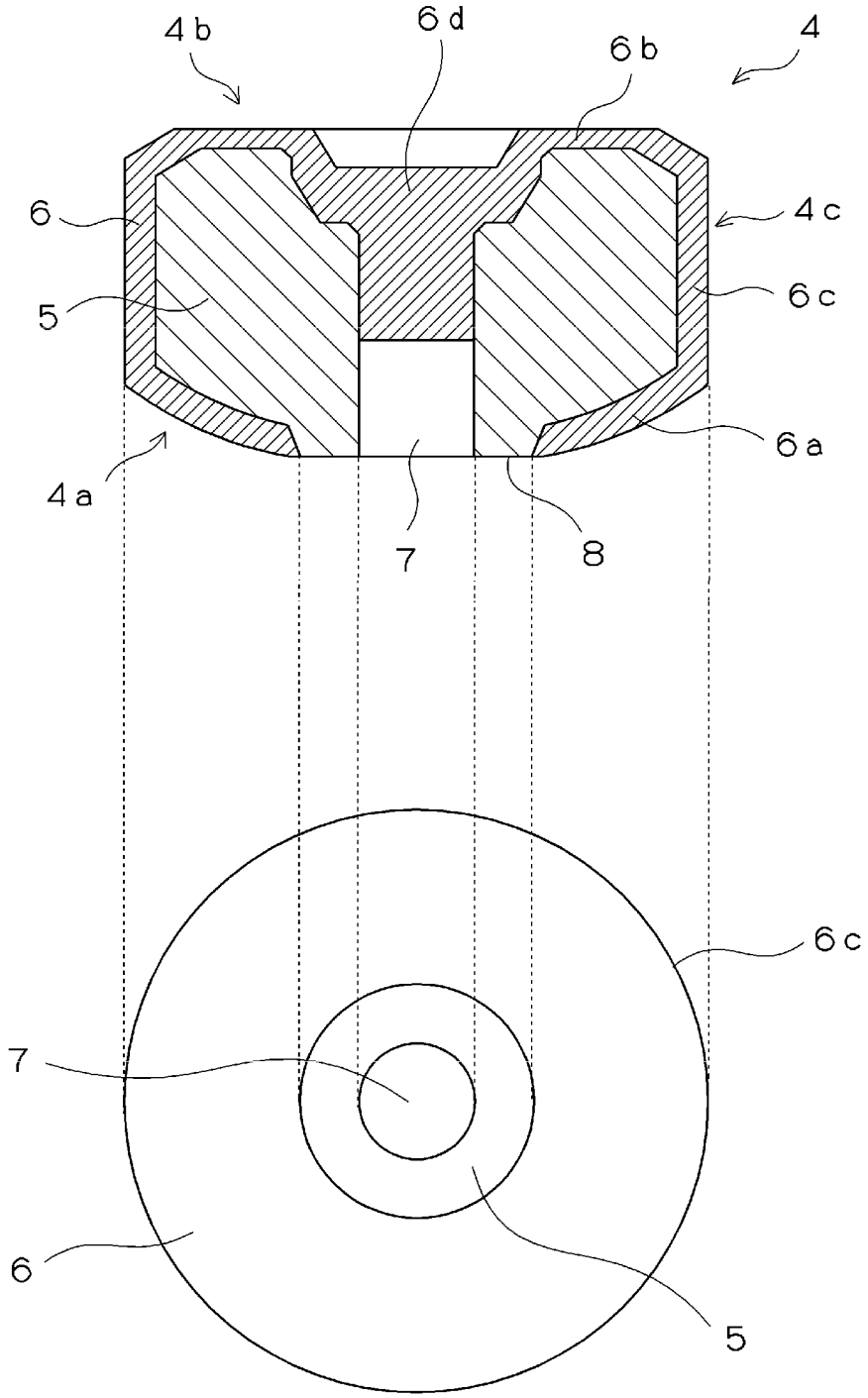
FIG. 2 is a vertical sectional view and a plan view showing the semispherical shoe shown in FIG. 1 by enlarging the semispherical shoe.

The construction of the semispherical shoe is described in detail below with reference to FIG. 2. The upper illustration of FIG. 2 is a vertical sectional view showing one example of the semispherical shoe of the present invention. The lower illustration of FIG. 2 is a plan view thereof. As shown in FIG. 2, the semispherical shoe 4 has an approximately semispherical construction composed of a spherical part 4*a* constituting a part of a sphere of the semispherical shoe, a planar part 4*b* having a form obtained by cutting the sphere almost planarly at a side opposite to the position of the spherical part 4*a*, and a peripheral part 4*c* connecting the spherical part 4*a* and the planar part 4*b* to each other. The semispherical shoe 4 is circular in its planar configuration. The surface of the peripheral part 4*c* (surface of resin layer 6*c*) is formed as a peripheral surface of a cylinder. Regarding the entire configuration of the semispherical shoe 4, one of the bottom surfaces of a cylindrical body is shaped in a convex configuration constituting a part of a semisphere. The entire configuration of the semispherical shoe 4 is not limited to the above-described one, but may be shaped in any desired configuration so long as the semispherical shoe has the planar part to be subjected to the sliding contact with the swash plate and the spherical part to be subjected to the sliding contact with the piston. The semispherical shoe may have a configuration not having the above-described peripheral part (cylindrical part).

The semispherical shoe 4 is composed of a base material 5 consisting of a metallic member. A resin layer 6 is formed on the surface of the planar part 4*b* to be subjected to the sliding contact with the swash plate and on the surface of the spherical part 4*a* to be subjected to the sliding contact with the piston. A resin layer 6*a* is formed on the surface of the spherical part 4*a*, and a resin layer 6*b* is formed on the surface of the planar part 4*b*. A resin layer 6*c* is formed on the surface of the peripheral part 4*c*. The resin layer 6*b* of the planar part 4*b* and the resin layer 6*a* of the spherical part 4*a* are continuous with each other through the resin layer 6*c* of the peripheral part 4*c* and cover the surface of the base material 5. In a case where the diameter of the semispherical shoe is approximately 10 mm, the thickness of the resin layer covering the outer surface of the base material 5 is as thin as 0.1 to 0.7 mm. Thus the base material 5 is shaped along the entire configuration of the semispherical shoe 4. It is preferable to thinly form the resin layer in the above-described thickness range because it is easy for frictional heat to escape from friction sliding contact surfaces to the base material and thus thermal storage hardly occurs.

The semispherical shoe of the present invention is characterized in that the above-described resin layers are formed on the sliding contact surfaces of the metallic base material to be subjected to the direct sliding contact with both the piston and the swash plate and that an exposed part not covered with the resin layer is formed at portions other than the portions where the resin layers are formed. It is possible to dissipate heat generated by the sliding contact between the base material and the swash plate as well as the piston from the exposed part through the base material. Thereby it is possible to prevent the resin layers from melting and allow the semispherical shoe to have excellent wear resistance and seizure resistance. The position and form of the exposed part of the base material are not specifically limited so long as the exposed part is formed at portions other than the sliding contact surfaces of the base material to be subjected to the direct sliding contact with both mating members, namely, the piston and the swash plate. But to allow the base material to have excellent processability and heat dissipation property, it is preferable that (1) a hollow part forming a concave portion is formed in a direction from a spherical part side or from a planar part side at a central axis portion of the base material or (2) a hollow part penetrating through both the spherical part side and the planar part side is formed at the central axis portion of the base material and that at least one portion of the hollow part is not filled with the resin layer and exposed.

In the semispherical shoe having the form shown in FIG. 2, a cylindrical spatial hollow part 7 penetrating through the base material 5 at the spherical part side and the planar part side is formed at the central axis portion of the circular base material 5. The hollow part 7 is filled with a resin layer 6*d* disposed in a region from the planar part side to a predetermined axial depth. A portion (exposed portion) other than the above-described region is not covered with resin. Thus the surface of the base material constituting the hollow part is exposed. The frictional heat is released outside from the exposed portion of the hollow part 7. The exposed portion serves as an oil pocket having a function of retaining lubricating oil.

It is preferable to set the axial length of the exposed portion of the hollow part 7 to not less than ⅓ of the height of the semispherical shoe. By setting the axial length of the exposed portion of the hollow part to the above-described range, it is possible to allow the area of a heat dissipation part to be large and thus the hollow part to be excellent in its heat dissipation property. It is preferable to set the diameter of the hollow part 7 to the range of ⅙ to ⅓ of the diameter of the semispherical shoe 4. By setting the diameter of the hollow part to the above-described range, it is possible to allow the hollow part to secure the heat dissipation property of the hollow part and prevent the strength of the base material from lowering.

The semispherical shoe 4 having the form shown in FIG. 2 has a non-contact portion 8 which does not contact the piston on an outer surface of the spherical part side thereof. At the non-contact portion 8, the base material 5 is not covered with the resin layer 6 and exposed. The non-contact portion 8 is formed by cutting a portion of the spherical part 4*a* along a plane parallel with the planar part 4*b*. The non-contact portion is not subjected to the sliding contact with the piston. In the form shown in FIG. 2, the planar configuration of the non-contact portion 8 is circular. By forming the exposed non-contact portion on the outer surface of the semispherical shoe 4 at the spherical part side of the semispherical shoe, the frictional heat generated at the spherical part can be dissipated easily from the exposed portion. In the case of the non-contact portion 8 shown in FIG. 2, it is preferable to set the size (diameter) of the non-contact portion 8 to a range of ⅓ to ½ of the diameter of the semispherical shoe 4. By setting the size (diameter) of the non-contact portion 8 to the above-described range, it is possible to secure a sufficient area of the sliding contact between the spherical part and the piston and improve the heat dissipation property of the semispherical shoe.

Figure 3:
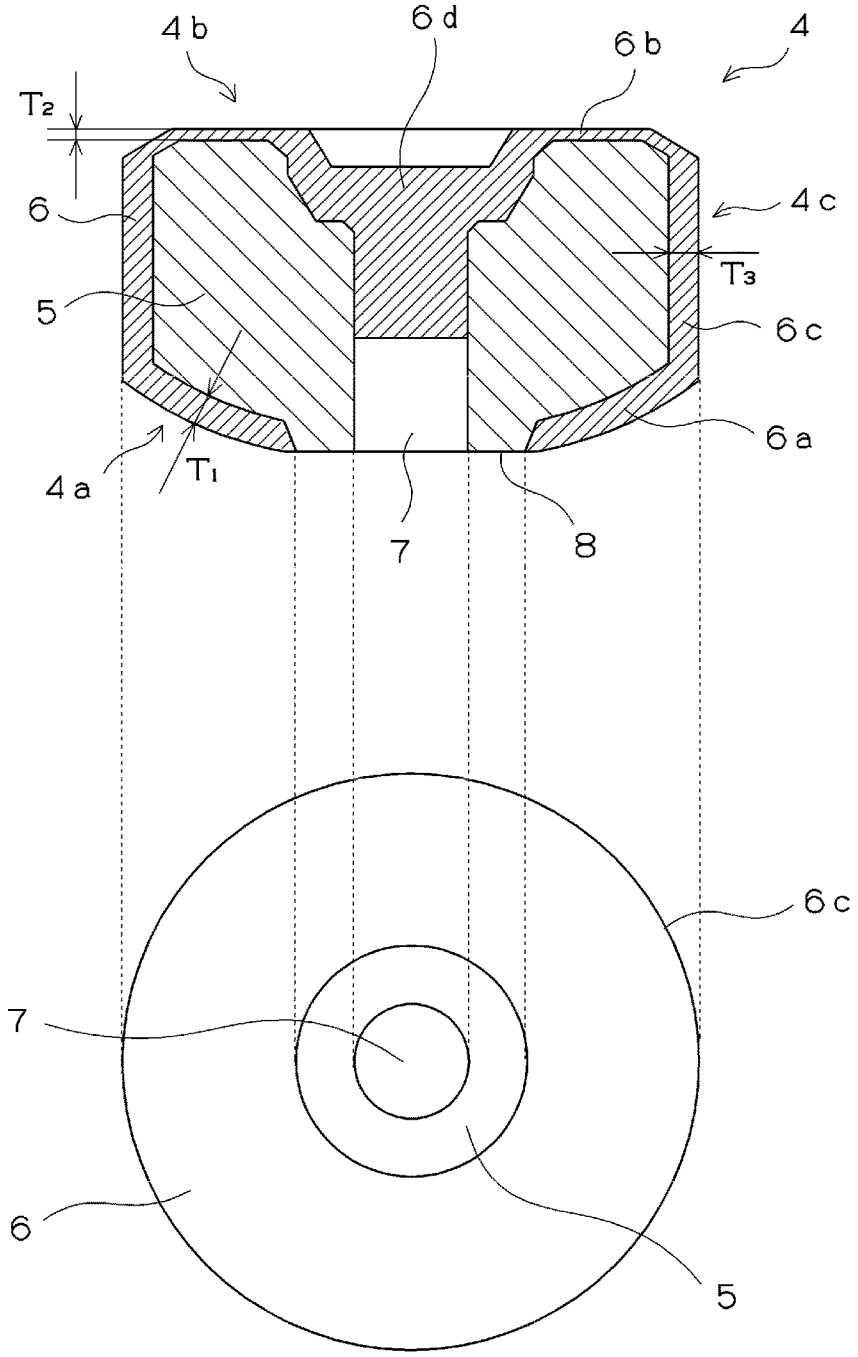
FIG. 3 is a vertical sectional view and a plan view showing another example of the semispherical shoe.

Regarding the thicknesses of the resin layers, it is preferable to set the thickness of the resin layer of the spherical part larger than that of the resin layer of the planar part. This form is described below with reference to FIG. 3. The upper illustration of FIG. 3 is a vertical sectional view showing one example of a semispherical shoe having this form. The lower illustration of FIG. 3 is a plan view thereof. In the case of the semispherical shoe 4 shown in FIG. 3, a thickness $T_1$ of the resin layer 6*a* of the spherical part 4*a* is set larger than a thickness $T_2$ of the resin layer 6*b* of the planar part 4*b* ($T_1>T_2$). Because the resin layer 6*b* of the planar part 4*b* to be subjected to the sliding contact with the swash plate is demanded to have a high load resistance at a high PV, it is preferable to set the thickness of the resin layer 6*b* of the planar part 4*b* as small as possible to promptly transmit the frictional heat to the base material. But to form the resin layer thinly by injection molding, resin is required to have high melt fluidity. Thus the thickness of the resin layer 6*a* formed on the surface of the spherical part 4*a* to be subjected to the sliding contact with the piston is set large to secure the melt fluidity. The surface of the convex spherical part 4*a* is subjected to the sliding contact with a concave spherical surface (spherical seat) of the piston. Because it is difficult to equalize the curvature of both spherical surfaces to each other, both spherical surfaces contact partially. But resin has comformability to the concave spherical surface of the piston owing to its fine deformation. Therefore the surface of the convex spherical part of the spherical part is apt to make surface contact with the concave spherical surface of the piston. Thus the resin layer of the spherical part is excellent in its wear resistance. The resin layer 6*a* comparatively thick is comformable to the concave spherical surface of the piston. In consideration of these points, thickness of the resin layer of the spherical part and that of the resin layer of the planar part are differentiated from each other as described above. In the present invention, the "thickness of the resin layer" means the thickness of a surface of the resin layer which does not penetrate into the base material.

As described above, the diameter of the semispherical shoe is set to about 10 mm (5 to 15 mm). In this form, it is preferable that the thickness $T_1$ of the resin layer 6*a* of the spherical part 4*a* is more than 0.3 mm and not more than 0.7 mm and that the thickness $T_2$ of the resin layer 6*b* of the planar part 4*b* is not less than 0.1 mm nor more than 0.3 mm. By setting the thickness of the resin layer of the spherical part and that of the resin layer of the planar part to the above-described range, the planar part 4*b* is allowed to have excellent load resistance, and the spherical part 4*a* is allowed to have excellent comformability to the spherical surface of the piston and a high melt fluidity at an injection-molding operation.

In consideration of the balance between the improvement of the melt fluidity of the resin layer 6*c* of the peripheral part 4*c* and the heat dissipation property thereof, it is preferable to set a thickness $T_3$ of the resin layer 6*c* of the peripheral part 4*c* equally to the thickness $T_1$ of the resin layer 6*a* of the spherical part 4*a*. It is preferable to set the thickness of the entire resin layer to 0.1 to 0.7 mm. In a case where the thickness of the resin layer exceeds 0.7 mm, it is difficult for the frictional heat to escape from a friction surface to the base material and thus the temperature of the friction surface becomes high. In this case, the resin layer deforms in a large deformation due to a load applied thereto and in addition, a true contact area of the friction surface becomes large, which causes a friction force to become large and a frictional heat to become high and thereby seizure resistance of the resin layer to become low. On the other hand, in a case where the thickness of the resin layer is less than 0.1 mm, the semispherical shoe has a short life.

Figure 4:
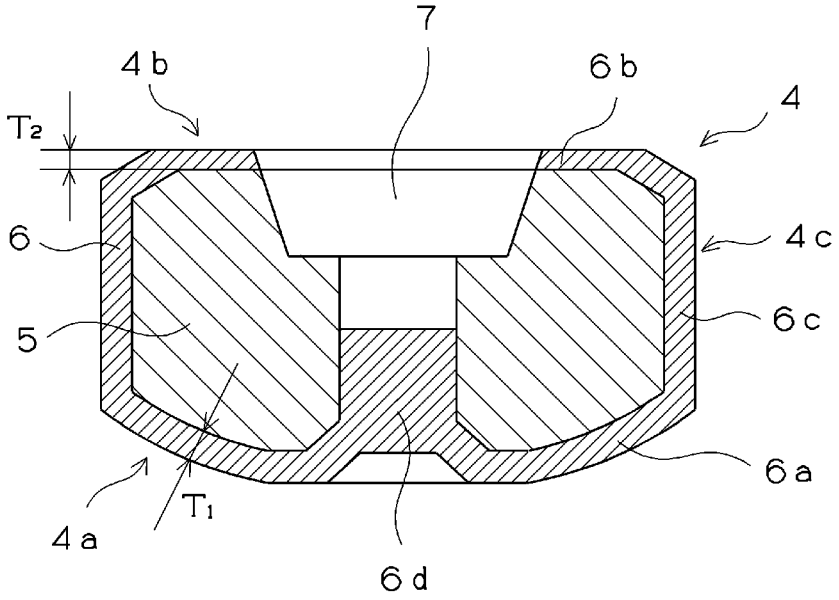
FIG. 4 is a vertical sectional view showing still another example of the semispherical shoe.
Figure 5:
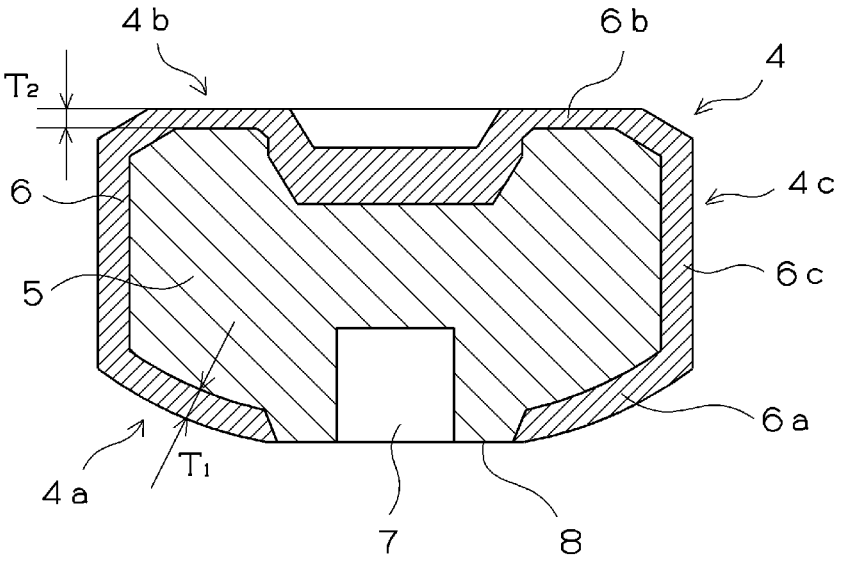
FIG. 5 is a vertical sectional view showing still another example of the semispherical shoe.
Figure 6:
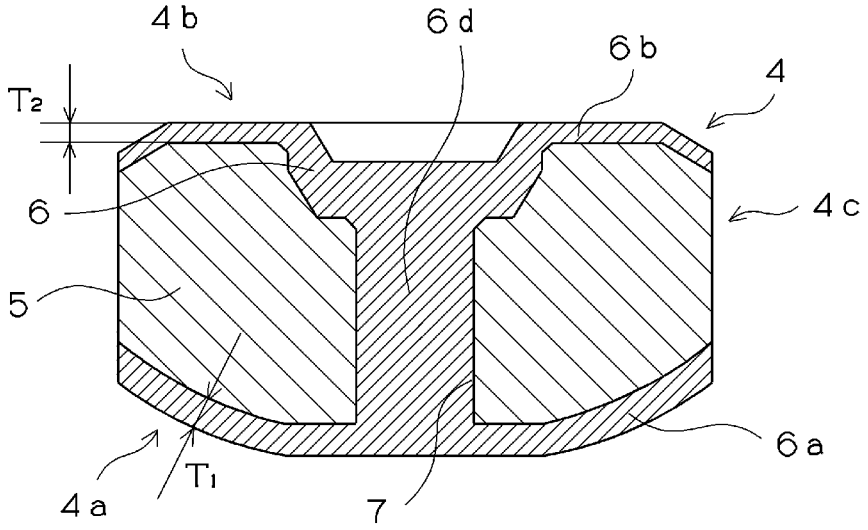
FIG. 6 is a vertical sectional view showing still another example of the semispherical shoe.

Other forms of the semispherical shoe of the present invention are described below with reference to FIGS. 4 through 6. FIGS. 4 through 6 are vertical sectional views showing other examples of the semispherical shoe. In the case of the semispherical shoe 4 shown in FIG. 4, the hollow part 7 penetrating through the spherical part side and the planar part side is formed at the central axis of the circular base material 5. In this form, the hollow part 7 is filled with the resin layer 6*d* formed in a region from the planar part side to a predetermined axial depth. A portion (exposed portion) other than the above-described region is not covered with resin. Thus the surface of the base material constituting the hollow part is exposed. Because the exposed portion of the hollow part 7 is disposed at the planar part side, the semispherical shoe is excellent in the sliding contact with the swash plate owing to the exposed portion which has a high heat dissipation property and functions as an oil pocket. In the case of the semispherical shoe 4 shown in FIG. 5, the cylindrical spatial hollow part 7 which forms a concave portion in a direction from the spherical part side is formed at the central axis of the circular base material 5. In this form, the hollow part 7 is not filled with the resin layer 6. Thus the surface of the base material constituting the hollow part is entirely exposed.

In the case of the semispherical shoe 4 shown in FIG. 6, the peripheral part 4*c* connecting the planar part 4*b* and the spherical part 4*a* to each other is not covered with the resin layer 6. Thus the base material 5 is exposed at the peripheral part 4*c*. Because the peripheral part 4*c* is not subjected to the sliding contact with the swash plate and the piston which are the mating members of the semispherical shoe, the formation of the resin layer on the peripheral part is not essential. Therefore it is possible to allow the base material to have a large exposed area serving as a heat dissipation part in the peripheral part than in the spherical part 4*a* and the planar part 4*b*. To increase the area of the heat dissipation part, a hollow part similar to the hollow part having the form shown in FIG. 5 may be formed on the peripheral part 4*c*.

In the semispherical shoe 4, the planar part 4*b* to be subjected to the sliding contact with the swash plate and the spherical part 4*a* to be subjected to the sliding contact with the piston are positioned at opposite sides in the axial direction of the semispherical shoe. By integrally and continuously forming the resin layers on the surface of the planar part 4*b* and that of the spherical part 4*a* through the peripheral part (FIGS. 2 through 5) or the hollow part (FIG. 6), the resin layers formed on the surface of the planar part and on the surface of the spherical part do not easily peel off the surface of the base material.

In any form shown in FIGS. 4 through 6, it is preferable to set the thickness $T_1$ of the resin layer 6*a* of the spherical part 4*a* larger than the thickness $T_2$ of the resin layer 6*b* of the planar part 4*b*. Thereby it is possible to obtain an effect equivalent to that of the form shown in FIG. 3.

Synthetic resins (base resin) which form the resin layer are not specifically limited, provided that the semispherical shoe secures its lubrication property and heat resistance demanded therefor. Examples of such synthetic resins include aromatic PEK resin such as polyether ether ketone (PEEK) resin, polyphenylene sulfide (PPS) resin, polyamideimide (PAI) resin, polyimide (PI) resin, and phenol resin. It is possible to use these synthetic resins singly or as polymer alloys consisting of mixtures of not less than two kinds thereof. Of these synthetic resins, the PEEK resin, the PAI resin, and PI resin excellent in the heat resistance and wear resistance thereof are preferable. The PEEK resin excellent in its fatigue property and flowability in an injection molding operation is especially preferable. To improve the wear resistance of the resin layer, carbon fiber, glass fiber, mica, talc and the like may be added to these synthetic resins. To allow the resin layer to have a low friction property and improve the seizure resistance thereof at an oil depletion time, polytetrafluoroethylene (PTFE) resin, graphite, and molybdenum disulfide may be added to these synthetic resins.

As a method of forming the resin layer, it is possible to adopt injection molding, spray coating, and powder coating. Of these methods, the injection molding is preferable because the injection molding is capable of forming the resin layer inexpensively and densely. In the injection molding, because pressure is applied to a resin composition when it is in a molten state, the resin layer is formed densely and is thus allowed to have high load resistance and wear resistance. As the injection molding method, it is possible to adopt a method of setting the base material of the semispherical shoe inside a die and injection-mold (insert-mold) the synthetic resin on the base material. In forming the resin layer by carrying out the injection molding, it is possible to mold the synthetic resin into a desired dimension by one-shot molding and in addition, machine injection-molded synthetic resin into a desired dimension.

In the present invention, as the method of forming the resin layer, it is preferable to adopt the insert molding method. To form the resin layer by adopting the insert molding, it is preferable to use the resin composition containing the aromatic PEK resin as its base resin and predetermined additives added to the aromatic PEK resin. The resin composition containing the aromatic PEK resin as its base resin is described below. Owing to the use of the aromatic PEK resin as the base resin of the resin composition, each resin layer containing the above-described resin composition is excellent in its heat resistance, oil resistance, chemical resistance, creep resistance, and frictional wear resistance. Thus it is possible to obtain a very reliable semispherical shoe. In addition, because each resin layer containing the above-described resin composition has high toughness and mechanical property at a high temperature and is excellent in its fatigue resistance and shock resistance, it is possible to prevent each resin layer from peeling off the base material due to frictional forces, shocks, and vibrations applied thereto during the operation of the swash plate compressor.

Examples of the aromatic PEK resin which can be used in the present invention include polyether ether ketone (PEEK) resin, polyether ketone (PEK) resin, and polyetherketoneetherketoneketone (PEKEKK) resin. As commercially available PEEK resin which can be used in the present invention, VICTREX PEEK (90P, 150P, 380P, 450P, 90G, and 150G) produced by Victrex Inc., Keta Spire PEEK (KT-820P, KT-880P) produced by SOLVAY SPECIALTY POLYMERS JAPAN K.K., and VESTAKEEP (1000G, 2000G, 3000G, and 4000G) produced by Daicel-Evonik Ltd are listed. As the PEK resin, VICTREX HT produced by Victrex Inc. is exemplified. As the PEKEKK resin, VICTREX ST produced by Victrex Inc. is exemplified.

It is preferable that the melt viscosity of the resin composition forming the resin layer is 50 to 200 Pa·s when the temperature of the resin is 380 degrees C. and the shear velocity thereof is 1000 $s^{-1}$. When the melt viscosity of the resin composition is in this range, it is possible to smoothly form the resin layer having a thickness as small as 0.1 to 0.7 mm on the surface of the base material of the semispherical shoe by the insert molding. Even in a case where a resin flow path of a portion connecting the resin layer of the spherical part and that of the planar part is narrow, a thin resin layer can be easily formed. By enabling the thin resin layer to be formed by the insert molding and eliminating post processing after the insert molding finishes, it is possible to easily produce the semispherical shoe and decrease the cost for producing it.

To allow the melt viscosity of the resin composition containing the aromatic PEK resin as its main component to have the above-described range, it is preferable to adopt the aromatic PEK resin whose melt viscosity in the above-described condition is not more than 150 Pa·s. As such aromatic PEK resin, of the above-described aromatic PEK resin, the VICTREX PEEK (90P, 150P, 90G, and 150G) produced by Victrex Inc. is exemplified. By using such aromatic PEK resin, it is easy for the resin material to enter into concaves and convexes of the surface of the base material consisting of a sintered metal member or the like in an injection molding operation. Thereby it is possible to allow the resin material to firmly adhere to the surface of the base material.

It is preferable to add mixing materials such as PTFE resin, graphite, molybdenum disulfide, and various whiskers, and carbon fiber to the resin composition forming the resin layer. It is especially preferable to add (1) the PTFE resin and (2) at least one of the carbon fiber and the graphite to the resin composition. By adding the PTFE resin to the resin composition, it is possible to allow the resin layer to have a low friction even in a condition in which the semispherical shoe is unlubricated or the lubricating oil is thin. Thus the semispherical shoe is not subjected to seizure in a dry state where the semispherical shoe runs out of lubricating oil while the semispherical shoe is being operated. By adding at least one of the carbon fiber and the graphite to the resin composition, it is possible to improve the creep resistance and frictional wear properties of the resin layer by oil lubrication and decrease the molding shrinkage factor of the resin composition.

As the mixing ratio of each component of the resin composition which forms the resin layer, the resin composition contains the aromatic PEK resin as its base resin. As essential components of the resin composition, it is favorable for the resin composition to contain (1) 1 to 30% by volume of the PTFE resin and (2) 5 to 30% by volume of at least one of the carbon fiber and the graphite. The remainder of the resin composition obtained by excluding the essential components (1) and (2) and a small amount of other additives from the entirety is the aromatic PEK resin. By setting the mixing ratio of each component of the resin composition to the above-described range, even in a high PV condition, it is possible to prevent the resin layer from deforming and wearing, reduce the extent of damage to the swash plate and the piston which are mating members of the semispherical shoe, allow the resin layer to have a high resistance to oil, and thus prevent the resin layer from being subjected to seizure even in a dry state where there is no oil during the operation of the swash plate compressor. It is more favorable for the resin composition to contain 2 to 25% by volume of the PTFE resin and 5 to 20% by volume of at least one of the carbon fiber and the graphite.

In a case where the mixing ratio of the PTFE resin exceeds 30% by volume, the wear resistance and creep resistance of the resin layer may be lower than a required extent. In a case where the mixing ratio of the PTFE resin is less than 1% by volume, a poor effect is obtained in imparting a required lubricity to the resin composition, which may cause the resin layer to have a sufficient sliding contact property.

In a case where the mixing ratio of at least one of the carbon fiber and the graphite exceeds 30% by volume, the resin composition has a low degree in its melt fluidity and thus there is a fear that it is difficult to thinly mold the resin composition. In a case where the resin composition contains a large amount of the carbon fiber, there is a fear that the swash plate and the piston which are the mating members of the semispherical shoe are subjected to abrasive wear. In a case where the mixing ratio of at least one of the carbon fiber and the graphite is less than 5% by volume, the resin composition lacks the effect of reinforcing the resin layer. Thereby there is a case where the resin layer is incapable of obtaining a sufficient degree of creep and wear resistances.

As the PTFE resin, it is possible to adopt any of molding powder formed by a suspension polymerization method, fine powder formed by an emulsion polymerization method, and reproduced PTFE. To stabilize the flowability of the resin composition containing the aromatic PEK resin as its base resin, it is preferable to adopt the reprocessed PTFE resin which is difficult to be fiberized by a shear acting thereon in a molding operation and makes it difficult for the resin composition to increase its melt viscosity. It is possible to use the PTFE resin modified by a side chain group having a perfluoroalkylether group, a fluoroalkyl group or other fluoroalkyl.

The reproduced PTFE means heat-treated (powder which has undergone thermal history) powder and powder irradiated with γ-rays or electron beams. Examples of the reproduced PTFE includes powder obtained by heat-treating molding powder or fine powder, powder obtained by irradiating the above-described powder with the γ-rays or the electron beams, powder obtained by pulverizing a molded body consisting of the molding powder or the fine powder, powder obtained by irradiating the above-described powder obtained by pulverizing the molded body consisting of the molding powder or the fine powder with the γ-rays or the electron beams, and powder obtained by irradiating the molding powder or the fine powder with the γ-rays or the electron beams. Of the reproduced PTFE powders, it is preferable to adopt the PTFE resin powder irradiated with the γ-rays or the electron beams, because this PTFE resin powder does not agglomerate, does not fiberize at the melting temperature of the aromatic PEK resin, has an internal lubricating effect, and is capable of stably improving the flowability of the resin composition containing the aromatic PEK resin as its base resin.

Examples of the commercially available PTFE resin which can be used in the present invention include KTL-610, KTL-450, KTL-350, KTL-8n, and KTL-400H all produced by Kitamura Co., Ltd.; Teflon (registered trademark) 7-j, TLP-10 produced by Mitsui Dupont Fluorochemicals Co., Ltd.; Fluon G163, L150J, L169J, L170J, L172J, and L173J all produced by Asahi Glass Co., Ltd.; POLYFLON and Lubron L-5 produced by DAIKIN INDUSTRIES LTD.; and Hostaflon TF9205, TF9207 produced by Hoechst Pharmaceuticals, Inc. Examples of the commercially available PTFE resin which is irradiated with the γ-ray or the electron beam and can be used in the present invention include KTL-610, KTL-450, KTL-350, KTL-8N, and KTL-8F all produced by KITAMURA LIMITED; and Fluon L169J, L170J, L172J, and L173J all produced by Asahi Glass Co., Ltd.

Although both pitch-based and PAN-based carbon fibers classified from a raw material may be used, the PAN-based carbon fiber having a high modulus of elasticity is more favorable than the pitch-based carbon fiber. Although a firing temperature of the PAN-based carbon fiber is not specifically limited, a carbonized product formed by firing the PAN-based carbon fiber at 1000 to 1500 degrees C. is more favorable than a graphitized product formed by firing the PAN-based carbon fiber at 2000 degrees C. or higher. This is because even under a high PV, the resin layer containing the carbonized product hardly subjects the swash plate and the piston which are the mating members of the semispherical shoe to abrasive wear. By using the PAN-based carbon fiber as the carbon fiber, the resin layer is allowed to have a high modulus of elasticity and thus have a low extent of deformation and wear. Further the friction surface has a small true contact area, and thus the extent of friction-caused generation of heat is allowed to be low.

It is favorable to set the average fiber diameter of the carbon fiber to not more than 20 μm and more favorable to set the average fiber diameter thereof 5 to 15 μm. The thick carbon fiber having a diameter exceeding 20 μm generates an extreme pressure. Thus the carbon fiber having a diameter in the above-described range is unpreferable in that it has a poor effect in improving the load resistance of the resin layer. According to a material of the mating members of the semispherical shoe, the mating members are subjected to abrasive wear to a high extent. Both chopped fiber and milled fiber can be used as the carbon fiber. But to obtain stable moldability in forming a thin resin layer, the milled fiber having a fiber length of less than 1 mm is more favorable than the chopped fiber.

The average fiber length of the carbon fiber is set to favorably 0.02 to 0.2 mm. In a case where the average fiber length thereof is less than 0.02 mm, the resin composition is incapable of obtaining a sufficient reinforcing effect. Thus the resin layer is inferior in its creep resistance and wear resistance. In a case where the average fiber length of the carbon fiber exceeds 0.2 mm, the ratio of the fiber length to the thickness of the resin layer is high. Thus moldability is inferior in forming a thin film. To enhance the stability in forming the thin film by molding the resin composition, the average fiber length of the carbon fiber is set to more favorably 0.02 to 0.1 mm.

As the commercially available pitch-based carbon fiber which can be used in the present invention, Kreca M-101S, M-107S, M-101F, M-201S, M-207S, M-2007S, C-103S, C-106S, and C-203S all produced by Kureha Corporation are exemplified. As the commercially available PAN based carbon fiber which can be used in the present invention, Besfight HTA-CMF0160-0H, HTA-CMF0040-0H, HTA-C6, HTA-C6-S all produced by Toho Tenax Co., Ltd.; and Toreca MLD-30, MLD-300, T008, and T-010 all produced by Toray Industries Inc. are exemplified.

The graphite is classified into natural graphite and artificial graphite. It is possible to use any of scaly, granular, and spherical graphite. In order to increase the modulus of elasticity of the resin composition, improve the wear resistance and creep resistance of the resin layer, and allow the resin layer to have stable low frictional property, it is preferable to use the scaly graphite.

Known additives for use in resin may be added to the resin composition to such an extent that the additives do not inhibit the effect of the present invention. Examples of the additives include a friction property improving agent such as boron nitride, tungsten disulfide; a thermal conductivity improving agent such as carbon powder, metal oxide powder; and a colorant such as carbon power, iron oxide, titanium oxide. In addition, the additives for use in resin include a wear resistance improving agent such as a granular inorganic filler including calcium carbonate, calcium sulfate, mica, and talc and an organic filler such as thermosetting PI resin, wholly aromatic polyester resin, and aramid fiber which do not melt at a temperature at which the above-described resin is injection molded.

Means for mixing the above-described raw materials with one another and kneading them are not specifically limited. A pellet of the resin composition to be molded can be obtained by dry-mixing only powder raw materials with one another by using a Henschel mixer, a ball mixer, a ribbon blender, a Redige mixer or an ultra Henschel mixer and thereafter by melt-kneading the raw materials with a melt extruder such as a twin-screw extruder. A filler may be supplied to the twin-screw extruder or the like by using a side feed method when the raw materials are melt-kneaded thereby. As described above, by using the pellet to be molded, the resin layer can be formed on the surface of the base material by the injection molding (insert molding). After the molding operation finishes, annealing treatment or the like may be performed to improve the property of the resin layer.

For example, in the case of the semispherical shoe 4 having the form shown in FIG. 2, the thin resin layer 6 is formed by directly injection-molding the resin composition containing the aromatic PEK resin as its base resin on the surface of the base material 5. More specifically, the insert molding is performed. That is, the resin is injection-molded on the base material 5 set inside a die. In performing the insert molding, the resin layer 6*b* of the planar part 4*b*, the resin layer 6*a* of the spherical part 4*a*, and the resin layer of the peripheral part 4*c* connecting the resin layers 6*b* and 6*a* to each other are integrally formed. As described above, it is preferable to set the thickness of each of the resin layers 6*a* and 6*b* of the semispherical shoe 4 to 0.1 to 0.7 mm. Each resin layer may be formed in a required thickness in performing the insert molding (one-shot insert molding) or by machining work after the insert molding finishes.

In performing the one-shot insert molding, it is preferable to set the thickness of each resin layer to 0.2 to 0.7 mm in consideration of the moldability of the resin composition. In a case where the thickness of the resin layer is less than 0.2 mm, there is a fear that it is difficult to perform the insert molding. In a case where the thickness of the resin layer exceeds 0.7 mm, there is a fear that a sink mark is generated and that the resin layer has a low dimensional accuracy. In consideration of the heat dissipation property of the frictional heat to the base material, it is more favorable to set the thickness of the resin layer to 0.2 to 0.5 mm. To form the resin layer having a thickness of 0.2 to 0.5 mm by the one-shot insert molding, as described above, it is preferable to set the melt viscosity of the resin composition to 50 to 200 Pa·s when the resin temperature is 380 degrees C. and the shear velocity thereof is 1000 $s^{-1}$.

As the metallic member to be used as the base material, members consisting of molten metals produced by press working, machining work or die casting are exemplified. Examples of the molten metal include bearing steel (SUJ1-5), chromium-molybdenum steel, carbon steel for mechanical structure, mild steel, stainless steel, steel such as high-speed steel, aluminum, aluminum alloys, copper, and copper alloys.

In using the molten metal as the metallic material of the base material of the semispherical shoe, to enhance the adhesiveness of the base material to the resin layer, it is preferable to roughen the surface of the base material in a concave-convex configuration by subjecting the surface of the base material to physical surface treatment such as shot blast or machining working or the like before the resin layer is formed. It is also preferable to subject the surface of the base material to chemical surface treatment such as acidic solution treatment (sulfuric acid, nitric acid, hydrochloric acid or mixed solutions consisting of these acids and other solutions) and alkaline solution treatment (sodium hydroxide, potassium hydroxide or mixed solutions consisting of these hydroxides and other solutions) to form a fine irregular configuration on at least the surface of the base material where the resin layer is to be formed. The acidic solution treatment is preferable because it eliminates the need for masking. The fine irregular configuration varies according to the concentration of the acidic solution or the alkaline solution, a treating period time, the type of post-treatment, and the like. To enhance the adhesiveness between the base material and the resin layer owing to an anchor effect, it is preferable to form fine concave portions at intervals of several nanometers to several tens of nanometers. Because the fine irregular configuration formed by the chemical surface treatment has a complicated porous three-dimensional structure, the fine irregular configuration easily displays the anchor effect and thus allows the base material and the resin layer to firmly adhere to each other. In addition, it is possible to form a chemical reaction film on the surface of the base material.

As the metallic member to be used to form the base material, it is possible to adopt a member consisting of a sintered metal whose surface is irregular. In the case where the sintered metal is used as the metallic material of the base material of the semispherical shoe, it is possible to enhance the adhesiveness between the resin layer and the base material because the sintered metal allows the surface of the base material on which the resin layer is to be formed to have a large area and a high anchor effect to be obtained owing to the irregular configuration of the surface of the sintered metal. Thus it is possible to enhance the adhesiveness between the resin layer and the base material. By forming the resin layer by the insert molding, the resin layer cuts deeply into the concave and convex portions of the surface of the sintered metal in an injection molding operation and thus the true joint area between the resin layer and the base material increases. Therefore the adhesiveness between the resin layer and the base material improves. Further because there is an increase in the true joint area between the resin layer and the base material and there is no gap therebetween, the heat of the resin layer is easily transmitted to the base material.

It is favorable to set the density of the sintered metal to 0.7 to 0.9 which is a theoretical density ratio of a material used as the sintered metal. The theoretical density ratio of the material used as the sintered metal means the ratio of the material to the theoretical density (density when porosity is 0%) thereof which is set to one. By setting the density of the sintered metal to this range, it is possible to allow the surface of the base material to be irregular so that the base material and the resin layer firmly adhere to each other and allow the base material to have a high degree of denseness. Thus it is possible for the base material to securely obtain a sufficient degree of thermal conductivity. In addition, because the joint portion between the resin layer and the base material is excellent in its joint strength, it is possible to prevent the resin layer from peeling off the base material even in a case where the semispherical shoe is used in a strict condition such as at a high surface pressure. In a case where the theoretical density ratio of the material used as the sintered metal is less than 0.7, the base material has a low strength, which may cause the base material to crack due to an injection-molding pressure in an insert-molding operation. In a case where the theoretical density ratio of the material exceeds 0.9, small concave and convex portions are formed. Thus the base material has a small surface area and a small anchor effect, which causes the base material to have a low extent of adhesiveness to the resin layer. It is more favorable to set the theoretical density ratio of the material to 0.72 to 0.84. In addition, to enhance the shear strength of the adhesion between the resin layer and the base material, it is possible to form a physical retaining portion or a rotation stopping portion such as concave and convex portions, grooves or the like on the surface of the member consisting of the sintered metal on which the resin layer is to be formed.

In a case where the base material is inserted into the die and the aromatic PEK resin is injection-molded to form the resin layer on the surface of the base material, the temperature of the die and that of the resin are set to 160 to 200 degrees C. and 360 to 410 degrees C. respectively. In a case where the base material has oil stuck to its surface or contains oil therein, oil residue which decomposes and gasifies is present on an interface between the resin composition and the base material in forming the resin layer by injection-molding the aromatic PEK resin. Thus there is a fear that the adhesiveness between the resin layer and the base material deteriorates. Therefore it is preferable to use a member made of the sintered metal not impregnated with oil as the base material. In a case where oil is used at the step of molding or reproducing (sizing) the member made of the sintered metal, it is preferable to remove oil by solvent cleaning or use a member made of the sintered metal steam-treated and oil-unimpregnated.

The surface of the resin layer to be subjected to the sliding contact with the swash plate and the piston may be subjected to abrasive machining after the resin layer is formed. The abrasive machining eliminates a variation in the heights of the concave and convex portions formed on the surface of the resin layer and improves dimensional accuracy. It is favorable to adjust the roughness of the surface of the resin layer to 0.05 to 1.0 μmRa (JIS B0601). By setting the roughness of the surface of the resin layer to the above-described range, the true contact area of the sliding contact surface of the resin layer to be subjected to the sliding contact with the swash plate and the piston becomes large. Thereby it is possible to lower the actual surface pressure and prevent the sliding contact surface of the resin layer from being subjected to seizure. In a case where the roughness of the surface of the resin layer is less than 0.05 μmRa, the supply of the lubricating oil to the sliding contact surface is insufficient. In a case where the roughness of the surface thereof exceeds 1.0 μmRa, the true contact area of the sliding contact surface decreases. Thereby a high pressure is applied locally to the sliding contact surface and thus there is a fear that the sliding contact surface may be subjected to seizure. It is more favorable to set the roughness of the surface of the resin layer to 0.1 to 0.5 μmRa.

To compensate the lubricating action at a dilute lubrication time, an oil pocket or a dynamic pressure groove may be formed in addition to the above-described hollow part on the surface of the resin layer to be subjected to the sliding contact surface with the swash plate and the piston. As the form of the oil pocket, speckled or streaky concave portions are exemplified. As the speckled or streaky configuration, parallel straight lines, lattice-shaped, spiral, radial or annular configuration concave portions are exemplified. The depth of the oil pocket can be appropriately determined in a range less than the thickness of the resin layer.

The swash plate compressor in which the semispherical shoe of the present invention is used is so constructed that inside the housing where the refrigerant is present, the rotational motion of the swash plate mounted perpendicularly and obliquely on the rotational shaft by directly fixing the swash plate thereto or indirectly fixing the swash plate thereto through the coupling member to the rotational shaft is converted into the reciprocating motion of the piston through the semispherical shoe to be subjected to sliding contact with the swash plate to compress and expand the refrigerant. By using the semispherical shoe of the present invention for the swash plate compressor, it is possible to eliminate the need for forming the lubricating film on the surface of the swash plate and that of the piston both of which are subjected to the sliding contact with the semispherical shoe. That is, the semispherical shoe is incorporated in the swash plate compressor without forming the lubricating film on the polished surface of the base material of the swash plate and that of the piston to allow the swash plate and the piston to be subjected to the sliding contact with the semispherical shoe. Thus the present invention is capable of providing the swash plate compressor having the function equivalent to that of conventional ones at a lower price than conventional ones.

INDUSTRIAL APPLICABILITY

The semispherical shoe of the present invention can be prevented from being subjected to seizure even in a dry lubrication state in which there is no lubricating oil at the start time of the operation of the swash plate compressor, is excellent in its sliding contact property and load resistance, does not deteriorate in its lubricating property due to generated frictional heat, prevents the resin layer from peeling off the surface of the base material, and ensures sufficient durability. Therefore the semispherical shoe of the present invention can be utilized for various swash plate compressors. The semispherical shoe can be suitably utilized for recent swash plate compressors in which carbon dioxide or HFC1234yf is used as the refrigerant and which is operated in a high-speed and high-load condition.

EXPLANATION OF REFERENCE NUMERALS AND SYMBOLS

1: housing
2: rotational shaft
3: swash plate
4: semispherical shoe
5: base material
6: resin layer
7: hollow part
8: non-contact portion
9: piston
10: cylinder bore
11: needle roller bearing
12: thrust needle roller bearing
13: spherical seat

The invention claimed is:

1. A semispherical shoe for a swash plate compressor so constructed that inside a housing where a refrigerant is present, a rotational motion of a swash plate mounted perpendicularly and obliquely on a rotational shaft by directly fixing said swash plate thereto or indirectly fixing said swash plate thereto through a coupling member to said rotational shaft is converted into a reciprocating motion of a piston through a semispherical shoe to be subjected to sliding contact with said swash plate to compress and expand said refrigerant, wherein said semispherical shoe is composed of a base material consisting of a metallic member, and a resin layer is formed on a surface of a planar part to be subjected to sliding contact with said swash plate and on a surface of a spherical part to be subjected to sliding contact with said piston by injection-molding a resin composition; and said resin layer of said planar part and said resin layer of said spherical part are integral with each other, and at least one portion of said base material is not covered with said resin layer and is exposed, wherein (1) a hollow part forming a concave portion in a direction from a spherical part side of said semispherical shoe or a planar part side thereof is formed at a central axis portion of said base material or (2) a hollow part penetrating through said spherical part side and said planar part side is formed at said central axis portion of said base material, and one portion of said hollow part is filled with said resin layer.

2. A semispherical shoe for a swash plate compressor according to claim 1, wherein at least one portion of said hollow part is not filled with said resin layer and in said at least one portion of said hollow part, said base material is exposed.

3. A semispherical shoe for a swash plate compressor according to claim 2, wherein an axial length of an exposed portion of said hollow part is not less than ⅓ of a height of said semispherical shoe.

4. A semispherical shoe for a swash plate compressor according to claim 1, wherein a non-contact portion which does not contact said piston is formed on an outer surface of said spherical part side, and said base material is not covered with said resin layer and is exposed at said non-contact portion.

5. A semispherical shoe for a swash plate compressor according to claim 1, wherein at least one portion of a peripheral part connecting said planar part and said spherical part to each other is not covered with said resin layer, and said base material is exposed at said one portion of said peripheral part not covered with said resin layer.

6. A semispherical shoe for a swash plate compressor according to claim 1, wherein said resin composition is a resin composition containing aromatic polyether ether ketone resin as a base resin thereof, a thickness of said resin layer of said planar part and that of said resin layer of said spherical part are 0.1 to 0.7 mm, and said resin layer of said planar part and said resin layer of said spherical part are formed integrally with each other on a surface of said base material by injection-molding said resin composition.

7. A semispherical shoe for a swash plate compressor according to claim 6, wherein said resin composition contains 1 to 30% by volume of polytetrafluoroethylene resin and 5 to 30% by volume of at least one of carbon fiber and graphite for 100% by volume of said resin composition.

8. A semispherical shoe for a swash plate compressor according to claim 6, wherein a melt viscosity of said resin composition is 50 to 200 Pas when a temperature of said resin composition is 380 degrees C. and a shear velocity thereof is 1000 $s^{-1}$.

9. A semispherical shoe for a swash plate compressor according to claim 1, wherein said metallic member consists of an iron-based sintered metal, and a density of said metallic member is 0.7 to 0.9 which is a theoretical density ratio of a material used as said base material.

10. A semispherical shoe for a swash plate compressor according to claim 1, wherein said resin layer of said spherical part is thicker than said resin layer of said planar part.

11. A semispherical shoe for a swash plate compressor according to claim 10, wherein a thickness of said resin layer of said planar part is not less than 0.1 mm nor more than 0.3 mm, and a thickness of said resin layer of said spherical part exceeds 0.3 mm and is not more than 0.7 mm.

12. A swash plate compressor so constructed that inside a housing where a refrigerant is present, a rotational motion of a swash plate mounted perpendicularly and obliquely on a rotational shaft by directly fixing said swash plate thereto or indirectly fixing said swash plate thereto through a coupling member to said rotational shaft is converted into a reciprocating motion of a piston through a semispherical shoe to be subjected to sliding contact with said swash plate to compress and expand said refrigerant, wherein said semispherical shoe is as claimed in claim 1.

13. A swash plate compressor according to claim 12, wherein a sliding contact surface of said swash plate to be subjected to sliding contact with said semispherical shoe is a polished surface of a base material of said swash plate and does not have a lubricating film thereon.

14. A swash plate compressor according to claim 12, wherein said refrigerant is carbon dioxide.

* * * * *